US006037964A

United States Patent [19]

Gomi et al.

[11] Patent Number: 6,037,964

[45] Date of Patent: Mar. 14, 2000

[54] EXPOSURE HEAD AND PRINTER

[75] Inventors: Masao Gomi; Fumitaka Murayama, both of Okaya, Japan

[73] Assignee: Cycolor System, Inc., Japan

[21] Appl. No.: 09/043,034

[22] PCT Filed: Jul. 7, 1997

[86] PCT No.: PCT/JP97/02353

§ 371 Date: May 5, 1998

§ 102(e) Date: May 5, 1998

[87] PCT Pub. No.: WO98/01304

PCT Pub. Date: Jan. 15, 1998

[30] Foreign Application Priority Data

Jul. 9, 1996 [JP] Japan ..... 8-179045

[51] Int. Cl.[7] ..... B41J 2/39

[52] U.S. Cl. ..... 347/238; 347/130; 347/118

[58] Field of Search ..... 347/130, 117, 347/118, 238, 244

[56] References Cited

U.S. PATENT DOCUMENTS

| | | | |
|---|---|---|---|
| 3,973,130 | 8/1976 | Amemiya | 378/66 |
| 4,168,894 | 9/1979 | Adolph | 396/318 |
| 4,378,149 | 3/1983 | Ebner | 396/549 |
| 4,928,122 | 5/1990 | Doe et al. | 347/241 |
| 5,444,520 | 8/1995 | Murano | 347/244 |

FOREIGN PATENT DOCUMENTS

| | | | |
|---|---|---|---|
| 61-171075 | 4/1985 | Japan . | |
| 4323670 | 4/1991 | Japan . | |
| 4327040 | 4/1991 | Japan . | |
| 5211666 | 4/1992 | Japan . | |
| 5278260 | 4/1992 | Japan . | |
| 04137675 | 12/1992 | Japan | B41J 2/45 |
| 8282006 | 10/1996 | Japan . | |

*Primary Examiner*—N. Le
*Assistant Examiner*—Hai C. Pham
*Attorney, Agent, or Firm*—Thompson Hine & Flory LLP

[57] ABSTRACT

An exposure head wherein a light-shielding panel having enclosing openings capable of receiving individual LED chips, and a front surface panel having small openings are disposed at a front surface of an LED panel in which the LED chips are arranged, is provided. In the exposure head, the LED chips and bonding wires can be housed in the enclosing openings, and can be protected from a medium to be exposed, by the front surface panel. Therefore, each dot can be irradiated with exposure light from the LED chips, which are disposed close to the photosensitive medium, so that each dot can be exposed without using a lens system. The inside surfaces of the enclosing openings are made reflective to prevent exposure light from leaking from the cells in which the individual LED chips are housed, into other LED chip cells, so that each dot can be exposed to high-intensity exposure light. Therefore, it is possible to provide a small-size and low-price exposure head capable of performing good-quality and high-resolution printing without color bleeding or the like, and a low-price printing apparatus employing the exposure head.

16 Claims, 6 Drawing Sheets

EXPOSURE HEAD AND PRINTER

TECHNICAL FIELD

The present invention relates to an exposure head and a printing apparatus that are capable of forming and outputting an image on a photosensitive sheet such as a Cycolor medium.

BACKGROUND OF THE INVENTION

As a method for forming a color photograph or a color print, there is a method for forming an image, such as a picture or a character, on a photosensitive sheet by exposing the sheet. There are different types of photosensitive sheets, for example, a photosensitive sheet employing a multi-layer color development method, in which three layers of photosensitive emulsions with different color sensitivities are layered on a single supportive sheet thus forming a photosensitive member, a photosensitive sheet that employs a film in which each emulsion layer contains a pigment and a developing agent so that the film is capable of being exposed and developed simultaneously, and the like. A still another photosensitive sheet called Cycolor medium, as shown in FIG. 1, which employs, as a photosensitive material, microcapsules (cyliths) 3*a*, 3*b*, and 3*c* that contain different chromogenic substance and different photoinitiators. In the Cycolor medium 1, a thin supportive body 2 formed from, for example, polyester, is coated with a photosensitive material layer 4 containing numerous cyliths of a very small size. When exposed to light, cyliths harden so that only the cyliths of a specific color are activated, and the cyliths are ruptured by pressurization, and then developed, thereby forming an image of a predetermined color. Other photosensitive sheets have different color development principles, but need to be exposed to exposure light of the color of an image or its complementary color to form an image.

In widely used methods for exposing a photosensitive sheet, white light is split into three primary colors by a filter or the like, and images are formed using the individual primary colors, and then combined to form an image of predetermined colors or an image of their complementary colors on the photosensitive.

Another technology has recently been developed, as disclosed in Japanese patent application laid-open Nos. Hei 5-211666 and Hei 5-278260, in which LEDs or lasers that emit red light, green light and blue light are employed as light-emitting sources, and the light-emitting sources are controlled so that an image of predetermined colors is formed on a photosensitive sheet and the sheet is thereby exposed. However, in an exposure apparatus employing LEDs or lasers as light sources as disclosed in Japanese patent application laid-open Nos. Hei 5-211666 and Hei 5-278260, a lens system is employed to converge light emitted from the LEDs or lasers onto a medium. To control colors in the unit of dots, it is necessary to employ expensive optical systems that require a large installation space, such as a scanning optical system, a micro-lens array, and the like. The micro-lens array and lens groups constituting the scanning optical system have a loss in light transmission, so that only a portion of the light emitted from the LED or laser light sources reaches the photosensitive sheet (medium). Therefore, in some cases, LEDs are not sufficient to provide an amount of light required for exposure of a photosensitive sheet. In other cases, the printing rate must be reduced and the printing time must be increases in order to secure a sufficiently long exposure duration. In addition, an optical system employing lenses requires a large installation space, and is costly, so that a printing apparatus becomes large and costly.

Accordingly, it is an object of the invention to provide a small-size and low-cost exposure head and a small-size and low-cost printing apparatus that are capable of converging light radiated from semiconductor light sources, such as LEDs, onto a photosensitive sheet, and forming an image on the photosensitive sheet using high-intensity light, without employing an optical system that causes a cost increase and a size increase.

If high-intensity exposure light is obtained from the semiconductor light sources, a compact-size exposure head can be provided, and it becomes possible to provide light sources separately for individual colors and control each exposure duration. Thus, it is another object of the invention to provide an exposure apparatus capable of setting a suitable exposure duration for a photosensitive sheet having photosensitive materials with different exposure characteristics for individual colors. It is still another object of the invention to provide a low-cost and small-size exposure head and a low-cost and small-size printing apparatus that are capable of forming high-quality images with good color balance and reduced color distortion, at a fast rate. For example, in some Cycolor media as described above, the exposure characteristics of photosensitive materials may differ depending on colors. Thus, it is a further object of the invention to provide an exposure head and a printing apparatus that are capable of forming an image with good color balance and reduced color distortion and therefore producing a high-quality color print, on media, such as the Cycolor media.

It is a further object of the invention to provide an exposure head and a printing apparatus that are capable of preventing uneven color development caused by individual variations of semiconductor light sources, such as LEDs, and therefore forming on a photosensitive sheet an image with good color balance and no distortion.

SUMMARY OF THE INVENTION

Accordingly, the exposure head of the invention comprises: a light source portion in which a plurality of semiconductor light sources capable of irradiating a photosensitive sheet with exposure light for forming an image on the photosensitive sheet are arranged; a front surface portion having a plurality of small openings that are formed at positions corresponding to the semiconductor light sources; and a light shielding portion having a plurality of enclosing openings at positions corresponding to the semiconductor light sources, the enclosing openings having a size that allows the semiconductor light sources to be housed in the enclosing openings, wherein the front surface portion, the light source portion and the light shielding portion are layered so that the light shielding portion is disposed between the front surface portion and the light source portion, and so that the front surface portion is installed on the face of the light source portion. That is, in the exposure head of the invention, the front surface portion having the small (fine or micro) openings enabling irradiation of the photosensitive sheet in the unit of dots (pixels) with exposure light emitted from the semiconductor light sources is layered so that the light shielding portion is disposed between the front surface portion and the light source portion and so that the front surface portion faces the photosensitive sheet. Therefore, the exposure head is able to irradiate the photosensitive sheet in the unit of pixels directly with exposure light emitted from the semiconductor light sources without using lens system. Therefore, it is possible to dispose the semiconductor light sources, such as LEDs, semiconductor lasers or the like, facing the photosensitive sheet in a bare chip state wherein there is substantially no distance between the semiconductor light sources and the photosensitive sheet, and to accordingly perform exposure. Since the photosensitive sheet is irradiated directly with exposure light emitted from the semiconductor light sources, high-intensity exposure light with reduced attenuation can be used to form an image on the photosensitive sheet. Furthermore, the front surface portion prevents the photosensitive sheet from directly contacting the semiconductor light sources, so that failures or deterioration of the semiconductor light sources or light shielding portion can be prevented.

The exposure head of the invention is able to converge light from the semiconductor light sources, such as LEDs or the like, onto the photosensitive sheet without using a lens system, such as a micro-lens array, a scanning optical system or the like, so that the exposure head can be reduced in size and can be provided at a low price. Furthermore, since the photosensitive sheet is irradiated directly with exposure light emitted from the semiconductor light sources, so that high-intensity exposure light without the attenuation owing to the lens system can be used, it is possible to print on a photosensitive sheet at a high speed. Further, since attenuation by a lens system is eliminated, employment of LEDs, whose light emission is less than that of lasers, as semiconductor light sources, will provide sufficiently high-intensity exposure light. Therefore, according to the invention, it is possible to provide a small-size and low-price exposure head capable of providing sufficient exposure light intensity by adopting semiconductor light emitting elements including LEDs, semiconductor lasers and the like, especially by adopting LEDs as semiconductor light source.

As for the light source portion, it is also possible to employ a light source portion in which a plurality of semiconductor light source are integrated in a single chip, such as a plane light-emitting laser (surface-emitting laser). However, in the present circumstances, it costs less to use semiconductor light emitting elements, such as LEDs, semiconductor laser elements, or the like, as individual semiconductor light sources. Further, such semiconductor light emitting elements achieve higher yields, and therefore provide a highly reliable exposure head. The exposure head of the invention is provided with the light shielding portion performing a function of a spacer as well, so that the light shielding portion, in which the semiconductor light sources are housed in the enclosing openings individually or in groups, can be sandwiched by the light source portion and the front surface portion, thereby forming a layered arrangement.

Exposure light emitted from the semiconductor light sources housed in the enclosing openings is directed to the photosensitive sheet, passing only through the small openings (fine or micro aperture) corresponding to the semiconductor light sources. Therefore, the influence of exposure light emitted from adjacent semiconductor light sources is blocked or shielded, thereby preventing color bleeding or the like caused by irradiation of a medium with light travelling from other semiconductor light sources through small openings. Further, since exposure light from the semiconductor light sources inside the enclosing openings is allowed to radiate only though the small openings corresponding to the semiconductor light sources, the intensity of exposure light can be further increased, and the contrast can be enhanced. As a result, good-quality printing with an increased resolution can be achieved. Further, if the inside walls of the enclosing openings are formed as reflective surfaces, such as mirror surfaces or metal surfaces, loss of exposure light can be prevented, and the intensity of exposure light emitted through the small openings can be increased.

As described above, the light shielding portion has a function of optically separating the individual semiconductor light sources, in addition to the function of a spacer making it possible to house the semiconductor light sources, such as LEDs or the like, inside the enclosing openings and to layer the light source portion and the front surface portion. The enclosing openings may also be used as spaces for disposing bonding wires for the semiconductor light sources, such as LEDs. Therefore, employment of the light shielding portion provides a compact exposure head wherein the semiconductor light sources and the bonding wires can be housed without being damaged, and wherein the semiconductor light sources can be disposed close to the photosensitive sheet and perform exposure.

Furthermore, if the surface of the front surface portion of the exposure head, the surface facing the photosensitive sheet, is made black or non-reflective with low brightness, it becomes possible to substantially eliminate the effect of reflection of exposure light from the photosensitive sheet and the front surface portion, and to perform still higher-quality printing with reduced color bleeding or the like.

Further, the light shielding portion provided with the enclosing opening may be provided with a suitable strength to support the exposure head, so that the front surface portion and the light source portion can be mounted and supported on the light shielding portion. By using the light shielding portion also as a supporting member, it becomes possible to suitably control the distance between the front surface portion and the photosensitive sheet even if the thickness of the light source portion varies. In a printing apparatus provided with a head conveying apparatus for moving the exposure head in the scanning directions, it is preferable that the exposure head be moved, with the light shielding portion held, whereby a substantially constant distance between the front surface portion and the photosensitive sheet can be maintained even in an exposure head wherein the thickness of light source portion is different.

The invention is also applicable to a stationary type exposure head wherein semiconductor light sources, such as LEDs or the like, are arranged in the scanning directions perpendicular to the direction of conveyance of a photosensitive sheet so that dots in the scanning directions are exposed by using the individual semiconductor light sources. The invention is also applicable to an exposure head for a serial printer that moves the exposure head in the scanning direction to perform exposure. Particularly, in the case of a scanning type exposure head, it is possible to arrange the semiconductor light sources at suitable intervals such that when the exposure head moves (while it is moving or is repeatedly moving and stopping) and performs exposure, the same location in the photosensitive sheet can be irradiated with exposure light. It is possible to arrange the semiconductor light sources at suitable intervals such that the semiconductor light sources, such as LEDs or the like, can easily be mounted, and such that a certain strength of the enclosing openings can be maintained, and such that optical separation can be reliably achieved.

If semiconductor light emitting elements are employed in the exposure head of the invention, it becomes possible to arrange semiconductor light source groups of having different characteristics for individual colors in the exposure head. As a result, for a photosensitive sheet having exposure characteristics different for individual colors, semiconductor light sources that emit exposure light suitable to the exposure characteristics may be arranged so that printing with good color balance can be achieved. Furthermore, the exposure head of the invention provides sufficiently high intensity of exposure light emitted from the semiconductor light emitting elements, so that the intensity control range increases. In this respect, it becomes easy to adjust color tones for a photosensitive sheet having different exposure characteristics for individual colors, and it becomes possible to form a high-quality image with reduced color distortion or the like.

A scanning type exposure head can be arranged so that each dot of a photosensitive sheet can be exposed by the exposure light emitted from a single or the same semiconductor light source. As a result, despite individual variations of semiconductor light sources, it becomes possible to from, on a photosensitive sheet, a high-quality image with good color balance and no uneven color development or the like caused by the individual variations. Consequently, the exposure head does not need a circuit or mechanism for absorbing individual variations of semiconductor light sources, which is needed for exposure of dots in the scanning directions by using different semiconductor light sources. Furthermore, the management or control of characteristics of semiconductor light sources can be loosened, so that an exposure head capable of high-quality printing can be provided at a low price. Therefore, employment of the exposure head of the invention will provide a low-price and compact printing apparatus capable of high-quality printing.

In the scanning type exposure head, a plurality of semiconductor light source groups capable of emitting exposure light of respectively different colors can be arranged with suitable intervals left therebetween so that the same location (dot) on a photosensitive sheet can be irradiated with exposure light from the semiconductor light source groups. As a result, full color printing can be achieved. Further, if each of the semiconductor light source groups is constituted by a plurality of semiconductor light sources, it becomes possible to expose a single or same dot to light from the plurality of semiconductor light sources of a color even in a case where a single semiconductor light source would be insufficient to provide a required amount of light. Since a sufficient amount of light is thus secured for exposure, it becomes possible to form an exposure head capable of providing sufficiently high intensity of exposure light while employing semiconductor light sources, such as LEDs or the like, which emit only small amounts of light but can be obtained at low costs. If LEDs capable of emitting the individual colors of either a primary color group of red, green and blue or a primary color group of cyan, magenta and yellow are arrange as semiconductor light sources in the light source portion as described above, it becomes possible to provide a small-size, low-price and high-performance exposure head for color printing.

Therefore, it is possible to provide a small-size and low-price printing apparatus capable of providing a high-quality print at a high speed, by providing the exposure head of the invention and a sheet conveying means for conveying a photosensitive sheet relative to the exposure head. The printing apparatus of the invention is able to perform high-quality printing with good color balance and reduced color distortion or the like, even on a photosensitive sheet carrying photosensitive materials having different exposure characteristics for individual colors. Further, if a developing apparatus having a rotating body capable of performing pressurization development while being moved in the scanning directions synchronously with the head conveying apparatus is provided, a printing apparatus capable of performing full-color printing on Cycolor media can be provided.

BRIEF DESCRIPTION OF THE DRAWINGS

FIG. 7(*a*) is a plan view of the light-shielding panel, and

FIG. 7(*b*) is a side view of the light-shielding panel.

DETAILED DESCRIPTION OF THE PREFERRED EMBODIMENT

Figure 2:
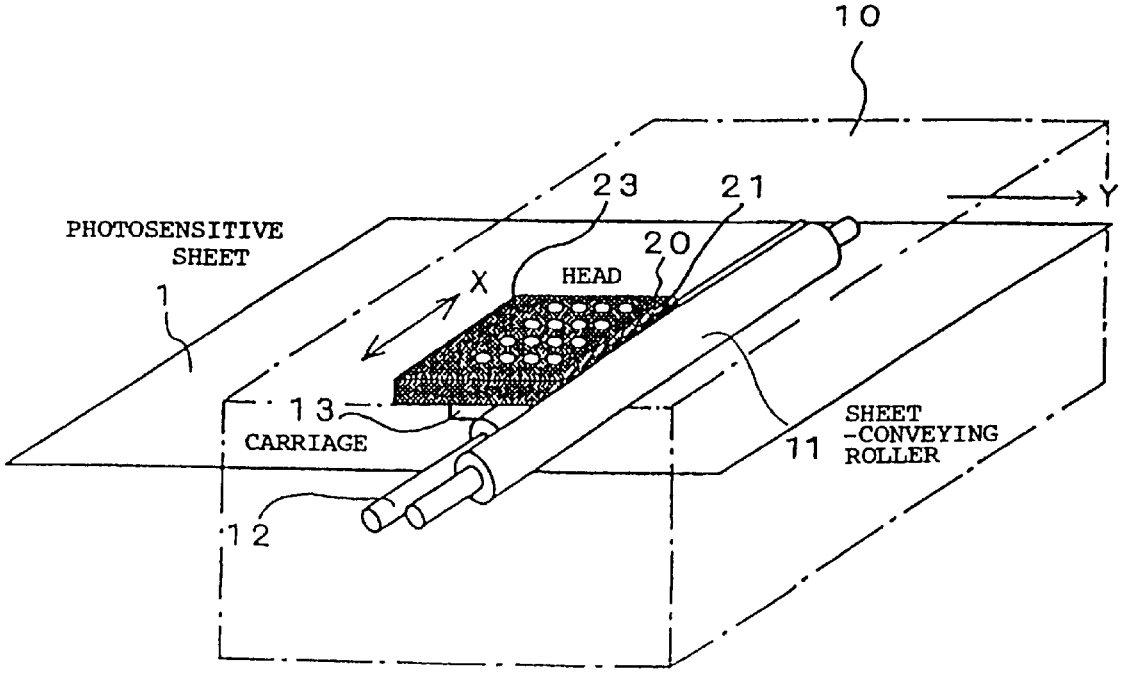
FIG. 2 is a diagram schematically showing the general construction of a printing apparatus according to the invention.
Figure 3:
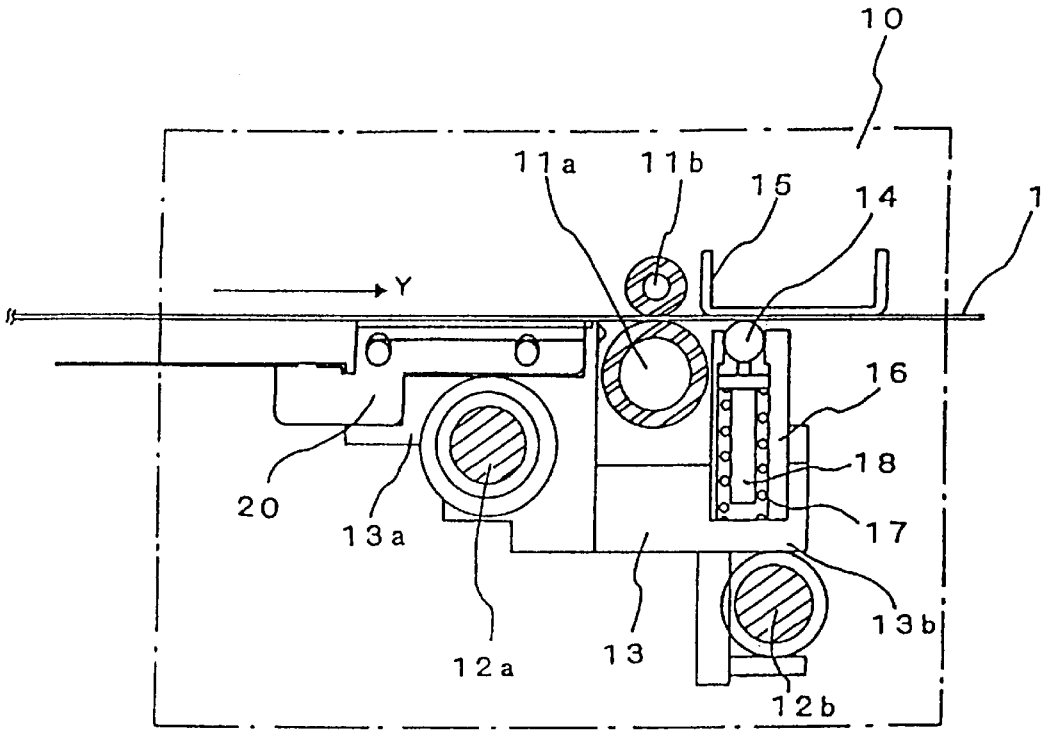
FIG. 3 is a sectional view showing the general construction of the printing apparatus shown in FIG. 2.

Modes for carrying out the invention will be described hereinafter with reference to the drawings. FIG. 2 shows the general construction of a printing apparatus according to the invention. FIG. 3 schematically shows the construction of a printing apparatus according an embodiment in a sectional view. A printing apparatus 10 of this embodiment is a serial type printer comprising sheet conveying rollers 11 for conveying photosensitive sheet 1 in a fixed direction (sheet conveying direction) Y, an exposure head 20 which is reciprocated in scanning directions X perpendicular to the sheet conveying direction Y to expose photosensitive sheet 1 and thereby form an image, and a carriage 13 being movable on shafts 12 extending the scanning directions X while carrying the exposure head 20. The carriage 13 is designed to be reciprocally moved at a constant speed in the scanning directions X by a carriage driving motor, by means of a timing belt or the like not shown in the drawings.

Figure 1:
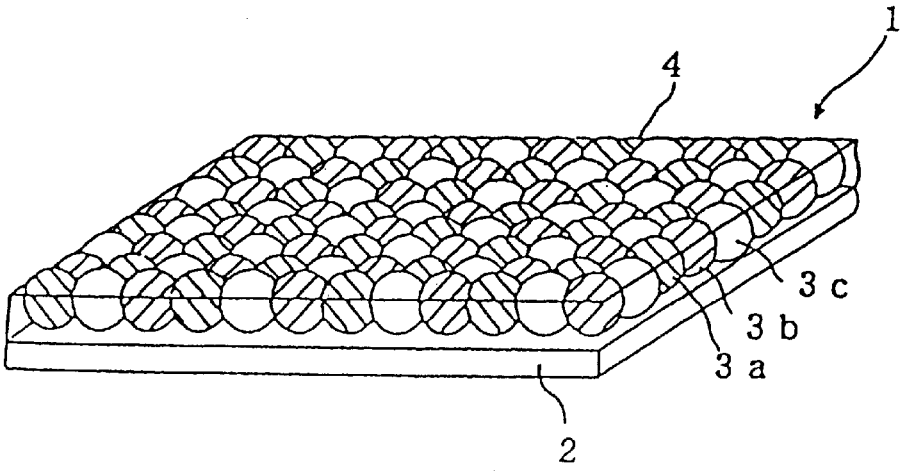
FIG. 1 is a diagram schematically showing a Cycolor medium in an enlarge view.

The printing apparatus 10 of this embodiment allows use of the Cycolor medium 1 as shown in FIG. 1, that is, the printing apparatus 10 is capable of exposing the Cycolor medium 1 for color printing. As described above, the Cycolor medium 1 is a medium in which a thin supportive body formed from, for example, polyester, is coated with numerous cyliths (microcapsules) containing chromogenic agents, and which is capable of forming a beautiful image closely like a photograph image, with a high resolution and a unique gloss. The Cycolor medium 1 does not require lamination for storage, and provides a highly durable print result. To print on the Cycolor medium 1, the exposure head 20 is first used to irradiate the Cycolor medium 1 with exposure light of a wavelength that matches the image to be formed, as indicated in FIG. 3. Due to the exposure light, cyliths containing a chromogenic substance (leuco-dye)of a complementary color of the wavelength of the exposure light are hardened, so that the leuco-dye contained in the cyliths is inactivated.

An area exposed by the exposure head 20 is moved in the sheet conveying direction Y by the sheet conveying rollers 11, and a next area is fed to the exposure head 20. The exposed area is pressurized by developing balls 14 that are moved together with the exposure head 20 by the carriage 13 in the scanning directions X, so that the cyliths are thereby pressurized. The active cyliths, other than the cyliths inactivated by the exposure light, rupture under the pressurization by the developing balls 14, so that the leuco-dyes undergo chemical reactions with an image receiving layer formed on the transparent polyester to develop desired colors. In the printing apparatus 10 of this embodiment, the Cycolor medium 1 is developed by the developing balls 14 and, at the same time, the medium 1 is heated by a heater 15 to stabilize the color development in a short time, so that the color development is substantially completed when the printed Cycolor medium 1 is discharged from the printing apparatus.

In the printing apparatus 10 of this embodiment, the medium 1 is clamped between the sheet conveying roller 11*a* and an sub-roller 11*b*, and thereby conveyed reliably at a predetermined timing in the direction Y. The carriage 13 for moving the exposure head 20 in the scanning directions X is designed to also carry the developing balls 14. The exposure head 20 is mounted on feeding side 13*a* (upstream side) of a medium 1 of the carriage 13, and the developing balls 14 are mounted on a downstream side 13*b* on an opposite side of the sheet conveying rollers 11*a*, 11*b*. The carriage 13 is supported by a main shaft 12*a* that mainly receives the load of the exposure head 20, and by a sub-shaft 12*b* that mainly receives the load of the developing balls 14. The carriage 13 is moved in the scanning directions sliding on the shafts 12*a*, 12*b*, thereby moving the exposure head 20 and the developing balls 14. The carriage 13 has a housing 16 that receives the developing balls 14. Disposed inside the housing 16 are a coil spring 17 and a support 18 that transmits the force of the coil spring 17 to the developing balls 14. Therefore, when the carriage 13 is moved in the scanning directions, the developing balls 14 roll on the medium 1 and press the medium 1 against the heater 15, having a function of a platen, at a constant pressure.

Figure 4:
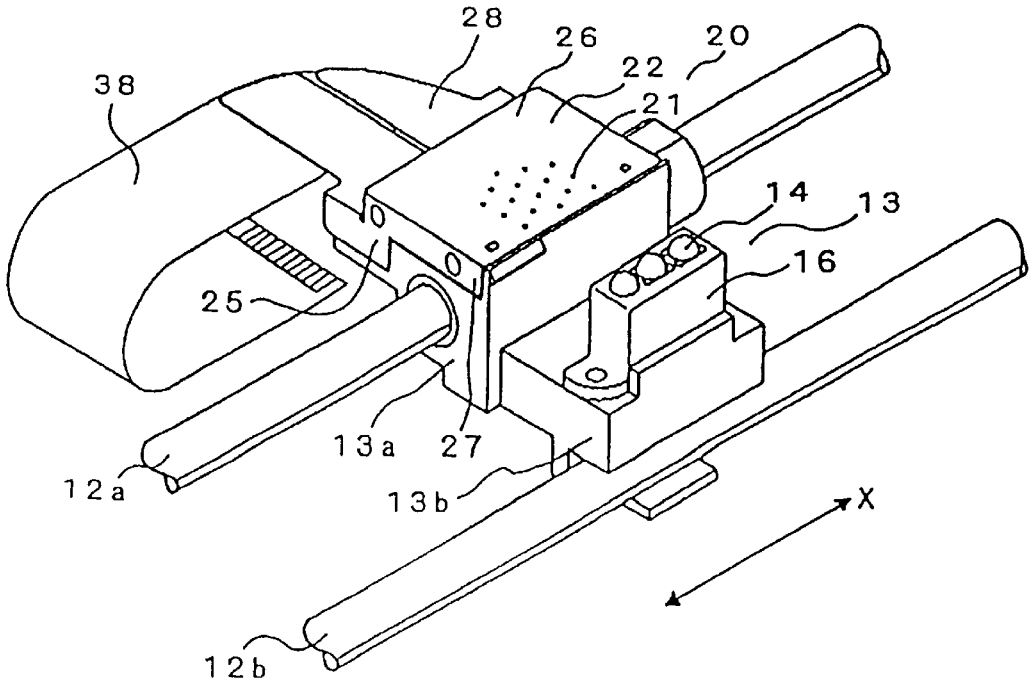
FIG. 4 is an enlarged perspective view showing an exposure head of the printing apparatus shown in FIG. 2.
Figure 5:
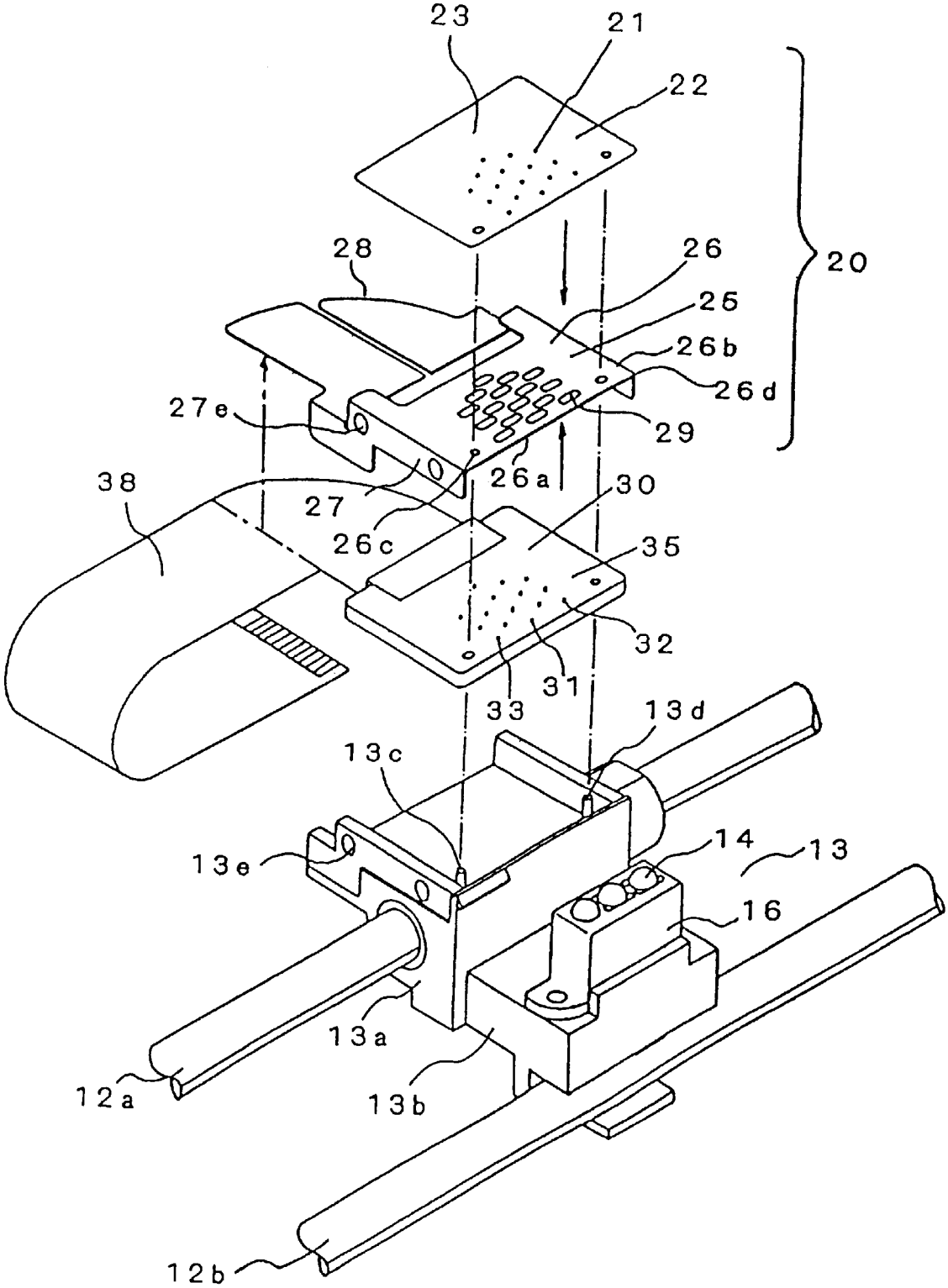
FIG. 5 is an exploded perspective view illustrating the construction of the exposure head shown in FIG. 4.

FIG. 4 shows an enlarged view of the exposure head 20 and its surroundings in the exposure head 20 of this embodiment. FIG. 5 shows an exploded view illustrating the construction of the exposure head 20. The exposure head 20 of this embodiment is mounted on the carriage 13 together with the developing balls 14. The exposure head 20 of this embodiment is a scanning-type exposure head that exposes the medium 1 while being moved along the shafts 12*a*, 12*b* in the scanning directions X, or repeatedly stopped and moved. As shown in FIG. 5, the exposure head 20 of this embodiment is formed of a laminate of three layers: an LED base board 30 carrying a plurality of LEDS 31–33; a front surface panel 22 in which small openings (micro-apertures) of about 0.3–0.1 mm in diameter are formed; and a light-shielding panel 25 disposed between the LED base board 30 and the front surface panel 22. The LED base board 30 serves as a light source unit. That is, the LEDs 31–33 emit light, and light passes through the small openings 21 of the front surface panel 22, which forms a front surface portion, so that the medium 1 is irradiated.

Figure 6:
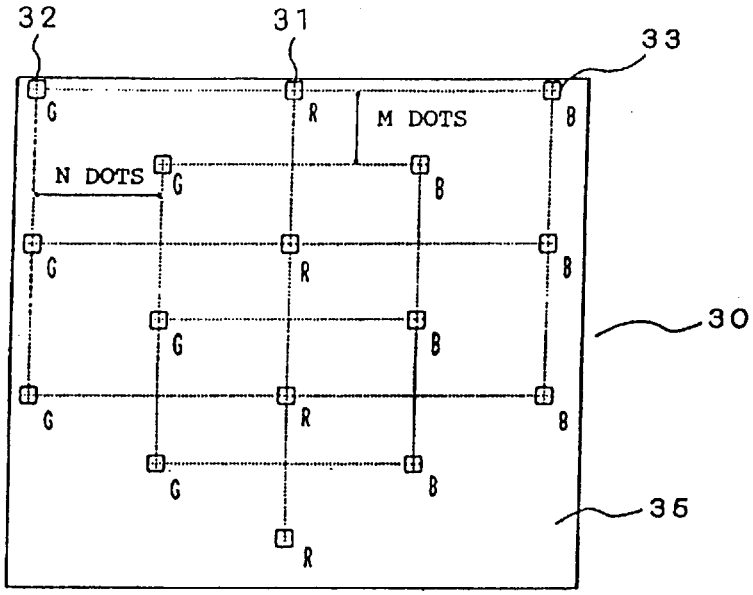
FIG. 6 is an enlarged view illustrating an arrangement of the surface of an LED panel shown in FIG. 5.

The plurality of LEDS 31–33, which are semiconductor light sources, are regularly arranged on the LED base board 30, which is a light source unit, as shown in the enlarged view of FIG. 6. The exposure head 20 of this embodiment is capable of color printing on the Cycolor medium 1. Therefore, LEDs of primary colors (three colors) of one group, that is, red (R) LEDs 31, green (G) LEDs 32 and blue (B) LEDs 33 are arranged on a surface 35 of the base board. The LEDs 31–33 of these colors form respective groups. That is, a plurality of LEDs are provided for each color. For example, four red LEDs 31 are arranged in a line substantially in the middle of the surface 35 of the base board. Six green LEDs 32 and six blue LEDs 33 are arranged at the opposite sides of the red LEDS 31 in each side portions of the surface 35 respectively.

These LEDs 31–33 are arranged on the surface of the LED base board so that their intervals are integer multiples of the pixel (dot) distant. Therefore, if the timing of light emission from the LEDs 31–33 is controlled on the basis of the moving distance of the exposure head 20 in the scanning directions X and the moving distance of the medium 1 in the sheet conveying direction Y, it is possible to irradiate a predetermined dot (a single dot, the same dot) on the surface of the medium 1 with light beams from the LEDS 31–33 (exposure light). Since the exposure head 20 of this embodiment is a scanning type, the LEDs can be arranged with a suitable interval left therebetween. Therefore, it is possible to form an enclosing openings of a suitable size at a suitable pitch as described below.

Since the LEDs 31–33 are arranged in the exposure head 20 of this embodiment, it is necessary to allow the exposure head 20 to move so that the LEDs 31–33 scan the surface (an area to be printed) of the medium 1. That is, it is necessary to move the exposure head 20 beyond the area to be printed, corresponding to the lateral and longitudinal dimensions of the arrangement of the LEDs 31–33 on the LED base board 30. Therefore, it is preferable that the LEDs 31–33 be arranged in a smallest-possible area on the surface 35 of the LED base board 30. To this end, in this embodiment, the LEDs 31–33 are arranged in a zigzag pattern, so that the area of the arrangement of the LEDs 31–33 is reduced while a sufficient distance between the LEDs 31–33 is provided. Employment of such a zigzag arrangement also provides a sufficient clearance between the enclosing openings 29 described below, so that the enclosing openings 29 of the light-shielding panel 25 can easily be arranged.

Figure 7:
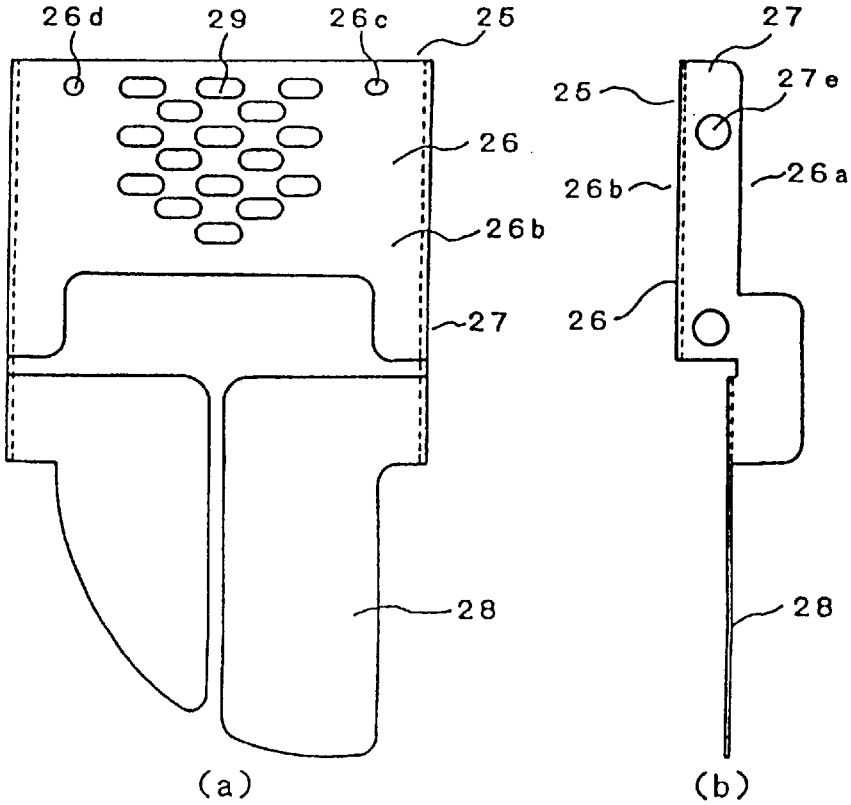
FIG. 7 schematically show light-shielding panel shown in FIG. 5.
Figure 8:
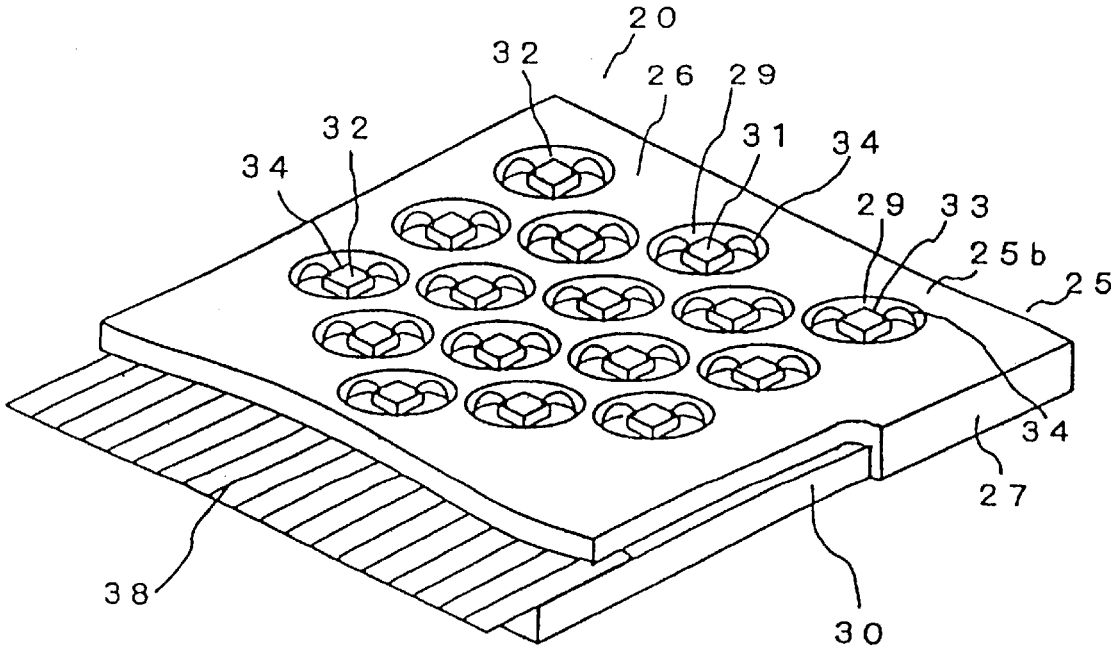
FIG. 8 is a perspective view schematically illustrating a state wherein LED chips are disposed in the light-shielding panel.

FIGS. 7 show the construction of the light-shielding panel 25, which is disposed between the LED base board 30 and the front surface panel 22 and also serves as a spacer. The light-shielding panel 25 of this embodiment is formed of a stainless steel plate member having a thickness of about 0.3 mm. The light-shielding panel 25 is formed mainly by a planar portion 26 that faces the surface 35 of the LED base board 30, support portions 27 extending from edges of the planer portion 26 so that the light-shielding panel 25 can be fixed to the carriage 13, a cable supporting portion 28 extending from the planer portion 26 in a direction upward the conveyance of the medium 1, and forming a quarter-circular shape. The planer portion 26 has a plurality of elliptical openings 29 that are formed corresponding to the arrangement of the LEDs 31–33 provided on the LED base board 30. When the LED base board 30 is adhered to a lower surface 26*a* of the planer portion 26, the individual LEDs 31–33 are housed in the individual openings 29 of the light-shielding panel 25 on one-to-one correspondence, as shown in FIG. 8. Therefore, the enclosing openings 29 in the light-shielding panel 25 are formed in accordance with the size of the LEDs 31–33. In this embodiment, since the LEDs 31–33 have a square shape whose sides are about 0.3 mm, the enclosing openings 29 have an elliptical shape of about 1–2 mm in size, so that the enclosing openings 29 can house the LEDs 31–33 and bonding wires 34 for supplying power to the LEDs 31–33. The shape of the enclosing or housing openings 29 is not limited to an elliptical shape. It is possible to adopt various shapes, such as a circular shape, a rectangular shape, and the like, depending on the size of the LEDs 31–33 disposed on the surface 35 of the LED panel, the manner of wiring, and the manner of connecting the bonding wires 34. Although, in this embodiment, the enclosing openings 29 are elongated in the scanning directions, the orientation of the housing openings 29 depends on, for example, the manner of connecting the bonding wires 34, and is not limited to the orientation in this embodiment.

In the exposure head 20 of this embodiment, light-shielding panel 25 serves as a strength member (supporting member). The LED base board 30 is adhered to the lower surface 26*a* of the planer portion 26 of the light-shielding panel 25, and the front surface panel 22 is adhered to an upper surface 26*b* thereof. The support portions 27 forming side surfaces of the light-shielding panel 25 are used to fix the light-shielding panel 25 to the carriage 13, thereby fixing the exposure head 20 to the carriage 13. The side surfaces of the carriage 13 have protrusions 13*e* that engage with holes 27*e* formed in the support portions 27 as shown in FIG. 5, whereby the light-shielding panel 25 can easily be fixed. To facilitate the positioning of the exposure head 20 to the carriage 13, projections 13*c* and 13*d* are provided protruding toward the medium 1. By inserting the projections 13*c*, 13*d* into holes 26*c*, 26*d* of the planer portion 26 when the exposure head 20 is mounted on the carriage 13, the position of the exposure head 20 relative to the carriage 13 in the scanning directions X or the sheet conveying direction Y can be held substantially fixed.

In exposure head 20 of this embodiment, the position of the front surface panel 22 on the side toward the medium 1 and the positions of the LEDs 31–33 (the gap between the medium 1 and the front panel 22 or between the medium 1 and the LEDs 31–33) can be held fixed relative to the carriage 13, by the light-shielding panel 25 serving as a supporting member, that is, by mounting the LED panel 30 to the carriage 13 using the light-shielding panel 25. Since the exposure head 20 of this embodiment is designed so that exposure light emitted from the LEDs 31–33 directly strikes the medium 1 without going through a lens system or the like, it is preferable to place the LEDs as close to the medium 1 as possible in a bare chip condition. However, the LED panel 30 varies in thickness from one LED panel to another depending on the production process of LED panels or the process of mounting the LEDs 31–33. Therefore, if the LED panel 30 is directly mounted on the carriage 13, it becomes necessary to provide a gap having a size between the carriage 13 and the medium 1 such that the individual variations of LED panels 30 (thickness variation) can be absorbed. Hence, the value of the gap varies depending on LED panels 30.

In the exposure head 20 of this embodiment, however, the surface 35 of the LED panel 30 is fixed to the light shielding panel 25 by adhesion or the like, so that a constant distance between the surface of the LED panel 30 and the medium 1 can be maintained despite the individual variation in thickness of LED panels. Therefore, it is possible to minimize the distance between the LEDs 31–33 and the medium 1 and maintain a substantially constant distance. Therefore, it becomes possible to realize an exposure head 20 capable of stably forming an image with an improved resolution on the medium 1.

The light-shielding panel 25 is provided with the cable supporting portion 28, which supports a print cable 38 extending from the LED panel 30. Since the exposure head 20 of this embodiment is moved in the scanning directions owing to the carriage 13, print data for the exposure head 20 is transmitted thereto, through the flexible print cable 38, which is movable together with the exposure head 20. In this embodiment, the print cable 38 is fixed to the cable supporting portion 28 of the light-shielding panel 25 by adhesion or the like, and the print cable 38 can be moved as the exposure head 20 is moved. Thereby, undesirable or excessive force will not act on the connecting portions between the print cable 38 and the LED panel 30. This construction prevents incidents where the connection between the print cable 38 and the LED panel 30 breaks, or where a cable breaks inside the print cable.

In the exposure head 20 of this embodiment, the LED panel 30 is fixed to the lower surface 26*a* of the light-shielding panel 25, and the front surface panel 22 having small openings is fixed to the upper surface 26*b* thereof, and the print cable 38 is fixed to the cable supporting portion 28, as described above. Therefore, it is possible to assemble to the light-shielding panel 25 all the components parts that constitute the exposure head 20, beforehand. If such an assembly is provided, the exposure head 20 can be incorporated into the printing apparatus 10 simply by fixing the light-shielding panel 25 to the carriage 13. Furthermore, since the positions of the component parts relative to the carriage 13 can be substantially fixed simply by fixing the light-shielding panel 25 to the carriage 13, the assembly of the printing apparatus 10 becomes easy, and precision in the positioning of the component parts can be improved. Furthermore, the entire exposure head can easily be replaced if a failure or problem occurs in the LED panel 30 or the like. Therefore, it is possible to provide a printing apparatus that facilitates maintenance. Further, the light-shielding panel 25 prevents interference between exposure light beams from the LEDs 31–33 as described below, and therefore increases the intensity of the exposure light for irradiation of the medium 1. Thus, high quality printing becomes possible.

Figure 9:
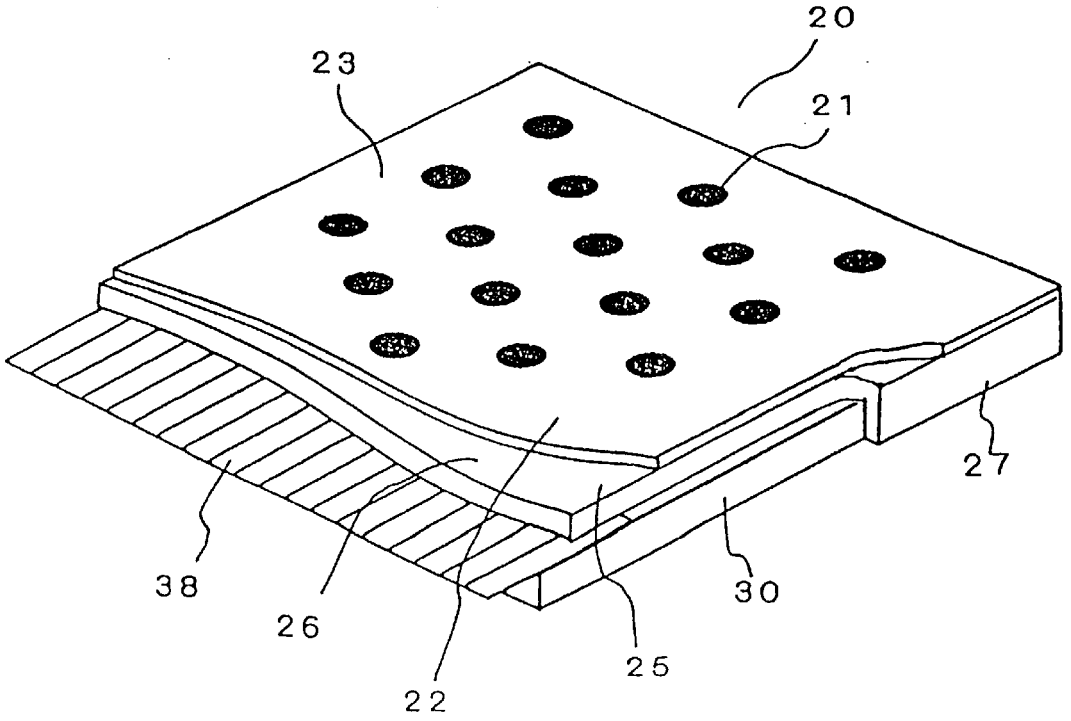
FIG. 9 is a perspective view schematically illustrating a state wherein a front surface panel is mounted on the light-shielding panel.

FIG. 9 schematically shows a state wherein the LED panel 30 and the front surface panel 22 are assembled to the light-shielding panel 25. The front surface panel 22 in this embodiment employs a metallic plate member, and has micro-apertures (small openings) 21 that are formed corresponding to the arrangement of the LEDs 31–33 so that the medium 1 is irradiated in the unit of dots (picture elements, pixels) with exposure light emitted from the LEDs 31–33. By delivering exposure light to the medium through the small openings 21, light emitted from the LEDs can be converged onto the dot unit without using a lens optical system. Since a space for a lens optical system is not necessary, it is possible to place the LEDs 31–33 at a position very close to the medium 1. Further, since the loss in amount of light due to a lens optical system is also eliminated, the medium 1 can be irradiated with high-intensity light. Since it is not necessary to use a lens optical system, which is complicated and expensive and requires a large space, it becomes possible to provide a small-size, high-performance exposure head and a small-size, high-performance printing apparatus at very low prices. In particular, since the exposure head 20 of this embodiment is a scanning type exposure head movable in the scanning directions, omission of a lens optical system achieves reductions in the size and weight of the exposure head 20, thereby reducing the load onto the carriage 13. Therefore, it becomes possible to reduce the size of the motor for driving the carriage 13 and improve the position precision due to the reduced drive load. In this respect as well, employment of exposure head 20 of this embodiment will provide a small-size printing apparatus capable of printing with high quality.

In the exposure head 20 of this embodiment, a surface 23 of the front surface panel 22 that faces a photosensitive sheet is provided with a black coating. Provision of the non-reflective surface 23 reduces the probability that a portion of exposure light reflecting from the surface of a photosensitive sheet will be reflected by the surface 23 of the front surface panel back to the photosensitive sheet, thereby affecting other dots. Since the non-reflective surface 23 can prevent exposure light emitted through the small openings 21 from affecting dots other than the target dot, color bleeding or blurring can be prevented and, in addition, high-quality good printing with a high resolution becomes possible. Although the surface color of the front surface panel 22 is preferably black, other colors with low brightness will achieve sufficient effect.

This embodiment employs the light-shielding panel 25 that has metallic inside surface 29*a*, that is, has a reflectivity, and the enclosing openings 29 formed in the light-shielding panel 25 house the individual LEDs 31–33. As a result, the light emitted from the LEDs 31–33 is reflected by the inside surfaces 29*a* of the enclosing openings 29 so that substantially the entire light passes through the apertures 21 and strikes the medium 1. Therefore, although small-diameter apertures are used as a light converging system, substantially the entire light emitted from the LEDs can be delivered through the apertures to the medium 1, thereby providing a sufficient amount of light.

Furthermore, since LEDs 31–33 are housed in the enclosing openings 29 individually separated by their inside surfaces 29*a*, there is no interference between light beams emitted from the other LEDs, so that the medium 1 can be exposed to light with a very high (substantially infinitely high) on/off contrast. Therefore, even applying an exposure head having an array of a plurality of LEDs 31–33, the medium 1 is not irradiated with an exposure light beam passing through an aperture not corresponding to the LED that emits the exposure light beam, so that an image with high contrast and no color bleeding or blurring can be formed.

Figure 10:
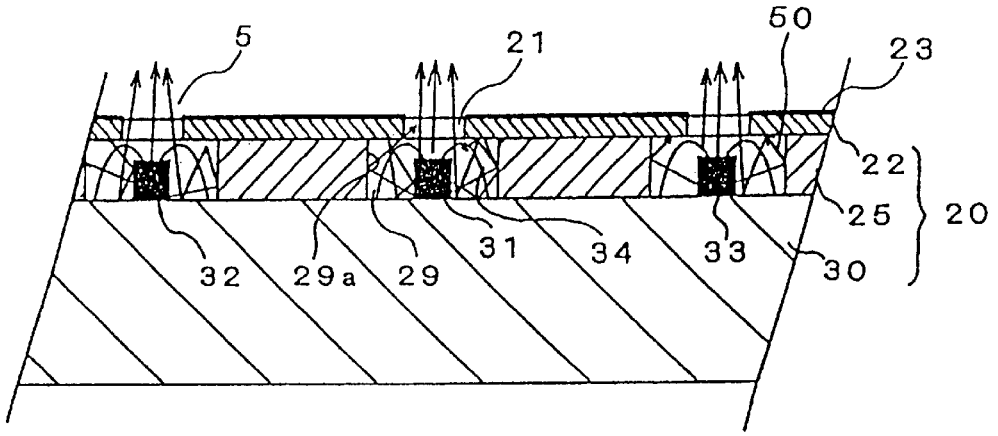
FIG. 10 is a sectional view illustrating the construction of an exposure head equipped with a light-shielding panel.
Figure 11:
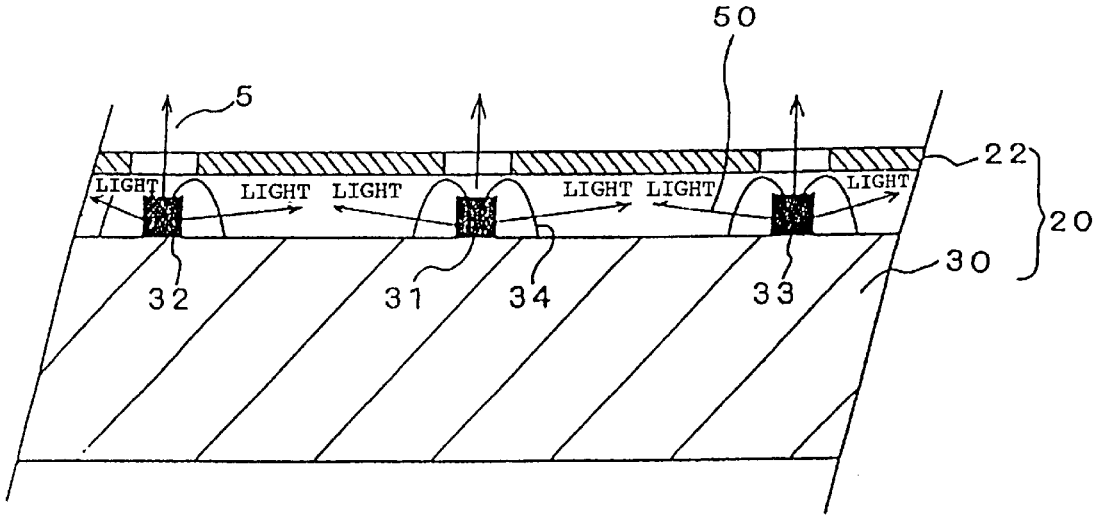
FIG. 11 is a sectional view illustrating the construction of an exposure head not equipped with a light-shielding panel.

Further description in detail will be made with reference to FIGS. 10 and 11. FIG. 10 schematically shows how exposure light 5 is emitted from the exposure head 20 employing light-shielding panel 25 according to the embodiment. FIG. 11 schematically shows an example employing an exposure head without a light-shielding panel. The LED bare chips 31–33 mounted in the LED panel 30 emit light 50 in all directions. As shown in FIG. 10, in the exposure head 20 of this embodiment, light 50 emitted from the LEDs 31–33 is reflected by the inside walls 29*a* of the enclosing openings 29, so that the light intensity inside the enclosing openings 29 increases. As a result, the light emitted from the LEDs 31–33 passes through the small openings 21 to strike the medium 1 without any substantial loss, thereby providing high-intensity exposure light 5.

On the other hand, in the exposure head without a light-shielding panel as shown in FIG. 11, light emitted from the LEDs 31–33 scatters in the gap between the front surface panel 22 and the LED panel 30. As a result, only a portion of the light emitted from the LEDs 31–33 is actually used to expose a specific dot on the medium 1. Moreover, light leaks from small openings corresponding to other LED chips, so that contrast in exposure decreases and, therefore, image quality deteriorates.

Naturally, by disposing the front surface panel 22 between the medium 1 and the LED chips 30, the interference between the medium 1 and the LEDs 31–33 or between the medium 1 and the bonding wires can be prevented. Therefore, it is possible to perform exposure using the LEDs 31–33 disposed very close to the medium 1. Consequently, it is possible to provide a small-size, light-weight, highly-reliable exposure head having no lens system. In particular, in a case where semiconductor lasers having good directivity are used as semiconductor light sources, sufficiently high-intensity exposure light can be provided. In addition, in a case where a light source unit formed of a single chip carrying a plurality of light sources, such as a plane light-emitting laser (surface emitting laser), is employed, an exposure head capable of forming a high-resolution image can be provided by protecting the surface of the light source unit with the front surface panel 22 having small openings.

In this embodiment, the light-shielding panel 25 has a function of a spacer between the front panel 22 and the LED panel 30, and provision of the light-shielding panel 25 enables enclosure of the individual LEDs 31–33 in separate cells. Therefore, the exposure head 20 of this embodiment can employ LED chips, which are inexpensive compared with semiconductor lasers and the like, and can efficiently irradiate the medium 1 with light from the LED chips. Consequently, it is possible to realize a low-price but high-performance exposure head capable of forming an image with a high contrast and a high resolution. Furthermore, since the LED chips and their wiring housed in cells formed by the enclosing openings 29 can be protected by the front surface panel 22, it is possible to provide a highly reliable exposure head 20.

In the exposure head 20 and the printing apparatus 10 of this embodiment, due to employment of the front surface panel 22 having small openings 21, the LED chips are placed in a bare chip state relative to the medium 1, without a significant space (gap) therebetween, so as to provide high-intensity exposure light. As a result, it also becomes possible to provide an exposure head having an array of many LED chips arranged in the scanning directions X so that dots in the scanning directions are simultaneously exposed for image formation by using different LEDs. However, since the characteristics of LED chips considerably vary depending on individual chips, it is necessary to absorb (correct) differences in luminous intensity (differences in amount of light) of light emitted from individual chips by adding a certain function or circuit. Consequently, it becomes necessary to employ a complicated and costly mechanism or circuit in order to form high-quality images. If such a mechanism or circuit is incorporated into a printing apparatus, the apparatus becomes large in size and costly, making it difficult to realize a small-size and low-cost printing apparatus. Moreover, circuits or mechanisms for correcting light quantity are difficult to adjust. This is another factor to increase the production cost, considering the labor and time required for assembly processes.

However, the exposure head 20 of this embodiment is a scanning type exposure head that performs exposure while moving in the scanning directions X, and is capable of exposing all the dots within the area in the medium to be printed, to light emitted from a single LED chip. That is, the LEDs 31–33 are arranged so that while the exposure head is moved for exposure, the individual LEDs 31–33 face any single dot in an area to be printed and can emit light thereto for exposure. Thus, each dot within the area to be printed is exposed to light from all the LEDs 31–33 provided in the exposure head (naturally, each dot is not necessarily exposed to full-power exposure light from all the LEDs, but the amount of exposure depends on the colors or gradation levels for printing). Therefore, uneven color development or distortion or the like in individual dots due to individual variations of LED chips will not occur, but very clear and beautiful images can be provided. Furthermore, employment of the exposure head 20 of this embodiment will eliminate the need for a mechanism or circuit to absorb individual variations of LEDs, thereby making it possible to provide a small-size and low-price printing apparatus.

To develop a photosensitive medium at a high speed, use of high-intensity exposure light is desirable. However, a powerful light source requires a large power source capacity, thereby making it impossible to use such an exposure head together with appliances for home or office use, such as personal computers. The exposure head and the printing apparatus of this embodiment increase the intensity of exposure light by eliminating a lens system. Furthermore, the exposure head and the printing apparatus of this embodiment make it possible to form a high-resolution image at a relatively high speed with a low electric power consumption by employing small-size and power-thrifty semiconductor light sources, that is, LEDs. Further, since the exposure head exposes a medium while being moved, the number of LEDs that are simultaneously turned on is smaller in this exposure head than in an exposure head wherein LEDs are arranged in an array in the scanning directions. In this respect too, the exposure head of this embodiment reduces the electric power consumption.

LEDs are low-cost, highly-reliable semiconductor light sources, but incapable of producing as much light as semiconductor lasers. Moreover, the light emitting efficiency of green and blue LEDs is lower than that of red LEDs. Therefore, employment of semiconductor lasers has mainly been considered for green and blue colors in exposure of a Cycolor medium 1. However, high-brightness LEDs have recently been developed, such as a GaN (blue LED) and a GaP (green LED). In addition to that, this embodiment has a construction, as shown in FIG. 6, wherein a plurality of LEDs 31–33 of a color are disposed in the LED panel 30, so that the group of semiconductor light sources for each color can be constituted by a plurality of LEDs. That is, a dot can be irradiated with exposure light from a plurality of LEDs for each color (each primary color) in this embodiment. Therefore, even in a case where a single LED is somewhat insufficient to provide a required amount of light of a color, employment of the exposure head 20 of this embodiment makes it possible to provide sufficiently high-intensity exposure light for exposure of a Cycolor medium 1.

Furthermore, in the exposure head 20 of this embodiment, the medium 1 is irradiated with exposure light from the LEDs disposed very close to the medium 1 in a bare chip state, so that the amount of light from each LED is sufficiently secured for exposure. Even in a case where a single LED is not sufficient to provide a required amount of light, a plurality of LEDs provide the required amount of light. In this construction, a margin can be provided for the energy (amount) of exposure light of each color, so that suitable control of energy of exposure light becomes possible. This is advantageous in multi-gradation printing. Further, because the energy of exposure light can be controlled separately for each color, the exposure head 20 of this embodiment will achieve high-quality printing with good color balance and reduced color distortion or the like, even on a medium coated with photosensitive materials of different colors having difference exposure characteristics. Some media vary in exposure characteristics depending on lots. Even in printing on such a medium, the exposure head 20 of this embodiment is capable of adjusting the color balance without affecting the exposure characteristics of other colors, because a margin is allowed in the amount (energy) of exposure light.

It is also possible to provide a stationary type exposure head having an array of many LEDs arranged in the scanning directions to simultaneously expose a plurality of dots, as stated above. However, considering use of a plurality of LEDs for exposure to light of a color, the exposure head will become a very large apparatus due to a great number of LEDs required, even if the LEDs are integrated. Therefore, size reduction of a printing apparatus becomes difficult. Moreover, use of many LEDs makes it more difficult to substantially eliminate the individual variations of LEDs, and therefore requires an expensive apparatus which has large-scale circuits and which requires time-consuming adjustment. In addition, due to the simultaneous powering of many LEDs, the electric power consumption increases.

Since the exposure head 20 of this embodiment is a scanning type that is movable in the scanning directions for exposure, a dot can be irradiated with exposure light a plurality of times using a reduced number of LEDs. Consequently, the exposure head 20 can be reduced in size, and the power consumption becomes very small, and elimination of the effect of individual variations is easy, as explained above.

Although this embodiment has been described with reference to an example of the exposure head having red, green and blue LEDs for Cycolor media employing cyan, magenta and yellow as primary three colors, it is also possible to use LEDs that emit light of the wavelengths of cyan, magenta and yellow. Naturally, it is possible to use not only LEDs but also semiconductors lasers, such as plane light-emitting lasers, or other semiconductor light sources. Although this embodiment employs the light-shielding panel formed of stainless steel, it is also possible to use other metal, such as aluminum, or resin, such as plastic, to form a light-shielding panel. In such a case, it is preferable that the inside walls of the enclosing openings be mirror surfaces or metal surfaces having high reflectivity, in order to efficiently deliver light from the semiconductor light sources to a medium. It should be apparent that the exposure head and the printing apparatus of the invention are not restricted by Cycolor media, but is similarly applicable to exposure apparatuses and printing apparatuses that form images on other types of photosensitive sheets.

As described above, the invention makes it possible to converge light emitted from the semiconductor light sources, such as LEDs or the like, onto a photosensitive sheet, such as a Cycolor medium or the like, by using the front surface panel having small openings. Therefore, it is possible to omit a large and costly lens system. It is possible to provide a small-size and low-price exposure head and a small-size and low-price printing apparatus that allow a considerable increase of the light intensity of exposure light and are capable of forming high-quality images on photosensitive media. Since the invention adopts a scanning type exposure head movable in the scanning directions, it is possible to provide a small-size and low-price exposure head and a small-size and low-price printing apparatus that are capable of printing at a high speed a high-quality image with good color balance and reduced color distortion or the like, while using low-cost semiconductor light sources, such as LEDs or the like. Consequently, employment of the exposure head and the printing apparatus of the invention will provide a color printing apparatus which allows easy use together with a personal computer at home or office, and which is small in size and light in weight thus achieving good portability, and consumes only a small amount of power, and which is capable of printing high-quality color images.

INDUSTRIAL APPLICABILITY

The invention provides an exposure head suitable to a compact-size and low-power-consumption printing apparatus, such as a printer, which is capable of full-color printing using a photosensitive sheet, such as a Cycolor medium, and a printing apparatus employing the exposure head. The exposure head and the printing apparatus of the invention are suitable to a small-size color printing apparatus that can be built in a personal computer body or can be carried and used together with a portable computer, such as a notebook type computer, a PDA or the like.

We claim:

1. An exposure head comprising:

a light source portion including a plurality of semiconductor light sources arranged for irradiating a photosensitive sheet with exposure light for forming an image on the photosensitive sheet;

a front surface portion having a plurality of small openings at positions corresponding to said semiconductor light sources; and a light shielding portion having a plurality of enclosing openings at positions corresponding to the semiconductor light sources, said enclosing openings having a size that allows said semiconductor light sources to be housed therein, said front surface portion and said light shielding portion being layered on said light source portion so that said front surface portion faces the photosensitive sheet and said light shielding portion is disposed between said front surface portion and said light source portion, said small openings of said front surface portion being smaller than said enclosing openings of said light shielding portion such that each enclosing opening is partially covered by said front surface portion, wherein exposure light from said semiconductor light sources passes directly through said small openings of said front surface portion to the photosensitive sheet without any intervening optical lens system.

2. An exposure head according to claim 1, wherein said front surface portion has a non-reflective surface that faces the photosensitive sheet.

3. An exposure head according to claim 1, wherein said front surface portion has a black surface that faces the photosensitive sheet.

4. An exposure head according to claim 1, wherein said enclosing openings have reflective inside surfaces.

5. An exposure head according to claim 1, wherein said light shielding portion has a strength to support said exposure head, and said front surface portion and said light source portion are mounted to said light shielding portion, said light shielding portion including side surfaces for attaching said exposure head to a carriage.

6. An exposure head according to claim 1, wherein said semiconductor light sources are semiconductor light emitting elements.

7. An exposure head according to claim 6, wherein said semiconductor light emitting elements are LEDs which emit exposure light of a color of a primary color group of red, green and blue, or a color of a primary color group of cyan, magenta and yellow.

8. An exposure head according to claim 1, wherein said exposure head is a scanning type exposure head that moves relative to the photosensitive sheet in a scanning direction to form the image, and wherein said semiconductor light sources are arranged so that when said exposure head moves and performs exposure, said semiconductor light sources can irradiate a same location on the photosensitive sheet with exposure light.

9. An exposure head according to claim 1, wherein said exposure head is a scanning type exposure head that moves relative to the photosensitive sheet in a scanning direction to form the image, and wherein said light source portion has a plurality of semiconductor light source groups which emit exposure light of different colors, and said plurality of semiconductor light source groups are arranged so that when said exposure head moves and performs exposure, said semiconductor light source groups can irradiate a same location on the photosensitive sheet with exposure light of the different colors.

10. An exposure head according to claim 9, wherein at least one of said semiconductor light source groups has a plurality of semiconductor light sources.

11. A printing apparatus comprising an exposure head according to claim 1, and a head conveying apparatus which attaches to said light shielding portion and moves said exposure head in a direction of scanning of the photosensitive sheet, said front surface portion and said light source portion each mounted to said light shielding portion.

12. A printing apparatus according to claim 11, further comprising a sheet conveyance apparatus that conveys the photosensitive sheet relative to said exposure head.

13. A printing apparatus according to claim 11, wherein said semiconductor light sources are arranged so that when said exposure head moves and performs exposure, said semiconductor light sources can irradiate a same location on the photosensitive sheet with exposure light.

14. A printing apparatus according to claim 11, wherein said light source portion has a plurality of semiconductor light source groups which emit exposure light of different colors, and said plurality of semiconductor light source groups are arranged so that when said exposure head moves and performs exposure, said semiconductor light source groups can irradiate a same location on the photosensitive sheet with exposure light of the different colors.

15. A printing apparatus according to claim 14, wherein at least one of said semiconductor light source groups has a plurality of semiconductor light sources.

16. A printing apparatus according to claim 11, comprising a developing apparatus having a rotating body which develops the photosensitive sheet by pressurization while being moved in the scanning direction synchronously with said exposure head by said head conveying apparatus.

* * * * *